US006085490A

United States Patent [19]

Buchko

[11] Patent Number: 6,085,490

[45] Date of Patent: Jul. 11, 2000

[54] FORMING WEB REGISTRATION CONTROL SYSTEM

[75] Inventor: Raymond G. Buchko, Neenah, Wis.

[73] Assignee: Rapidpak, Inc., Neenah, Wis.

[21] Appl. No.: 09/022,076

[22] Filed: Feb. 11, 1998

[51] Int. Cl.[7] ..... B65B 61/02

[52] U.S. Cl. ..... 53/411; 53/389.2; 53/389.4; 53/51; 493/11; 242/396.8

[58] Field of Search ..... 493/3, 11; 53/389.1, 53/389.2, 389.4, 411, 51, 52; 242/421.8, 422.4, 396.8

[56] References Cited

U.S. PATENT DOCUMENTS

| | | | |
|---|---|---|---|
| 3,762,125 | 10/1973 | Prena | 53/51 |
| 3,908,331 | 9/1975 | Donnet | 53/51 |
| 4,744,202 | 5/1988 | Wylie | 53/51 |
| 4,807,420 | 2/1989 | Barker | 53/51 |
| 4,868,759 | 9/1989 | Ross et al. | 53/51 |
| 4,897,984 | 2/1990 | Buchko et al. . | |
| 5,170,611 | 12/1992 | Buchko et al. . | |
| 5,205,110 | 4/1993 | Buchko . | |
| 5,470,300 | 11/1995 | Terranova | 493/11 |
| 5,785,270 | 7/1998 | Buchko | 242/422.4 |
| 5,795,280 | 8/1998 | Fowler | 493/11 |

*Primary Examiner*—Eugene L. Kim
*Attorney, Agent, or Firm*—Andrus, Sceales, Starke, & Sawall

[57] ABSTRACT

A system and method of obtaining precise registration of a forming web in an indexing motion web advancement mechanism wherein the web has spaced registration marks for defining an area of distorted printing provided thereon. The web is passed from a supply roll through a braking arrangement, a photosensing mechanism for sensing the registration marks on the web and a heater system movable back and forth relative to the web to a nip roller arrangement having one or more rolls driven by an unwind motor. The web is indexed from the supply roll by operation of the unwind motor. A first registration mark on the web is sensed by a photosensing mechanism and the feeding of the web from the supply roll is immediately stopped using the braking arrangement. The web is stretched downstream of the heater system by continuing to operate the unwind motor to apply tension to the web. The unwind motor is stopped and heat is applied to the web by moving the heater system towards the web upon the adjacent registration mark downstream of the first registration mark. This motion is used to attain a predetermined precise length for supply into the web advancement mechanism downstream of the nip roller arrangement.

24 Claims, 5 Drawing Sheets

FIG. 11
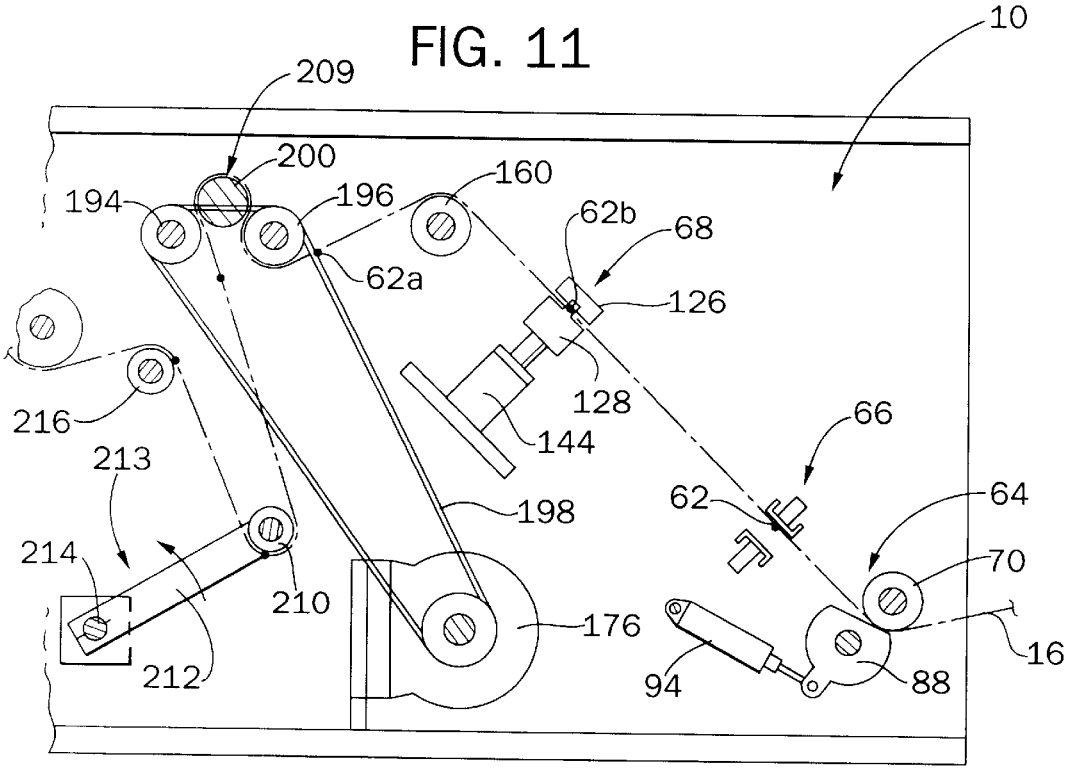
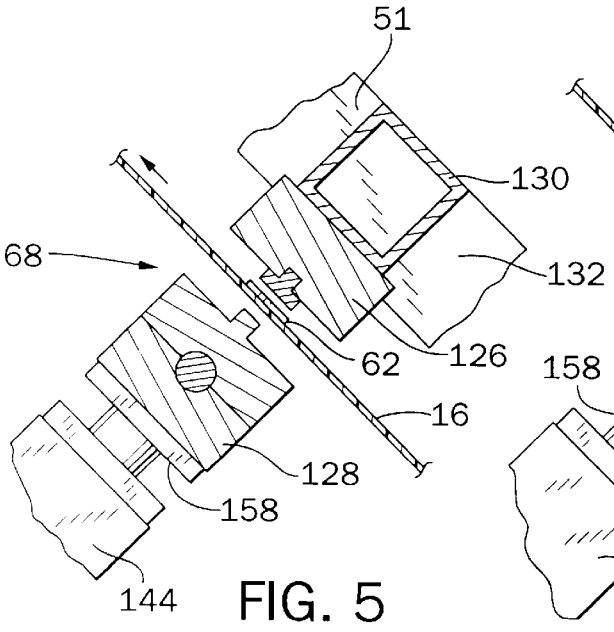
FIG. 5
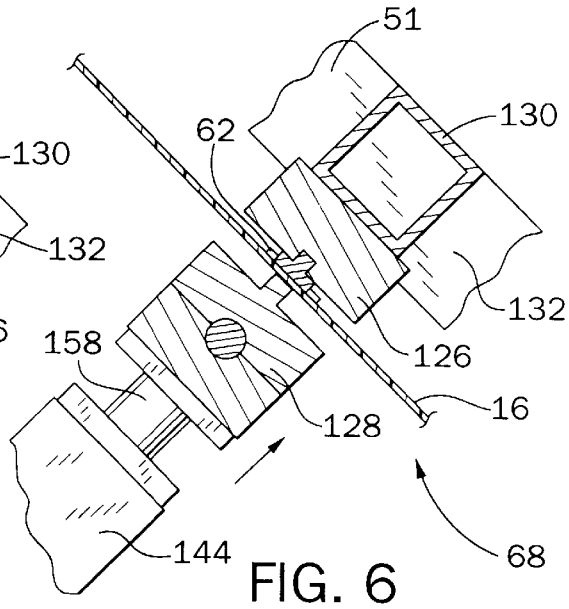
FIG. 6

FIG. 9
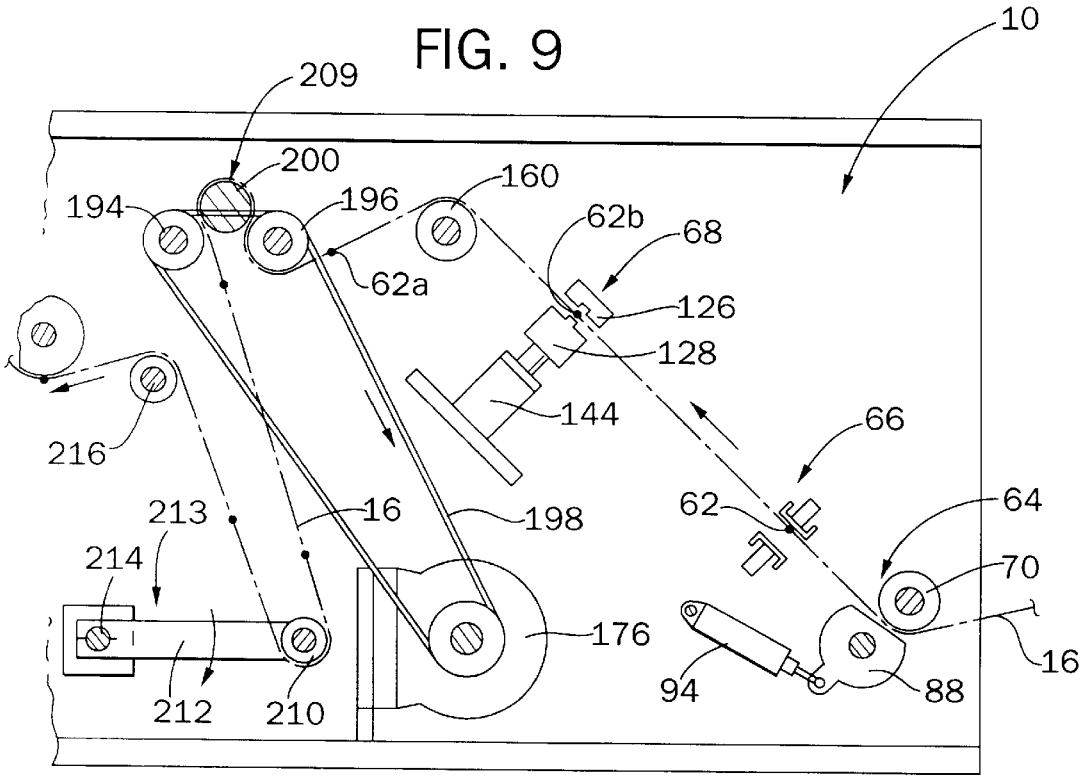
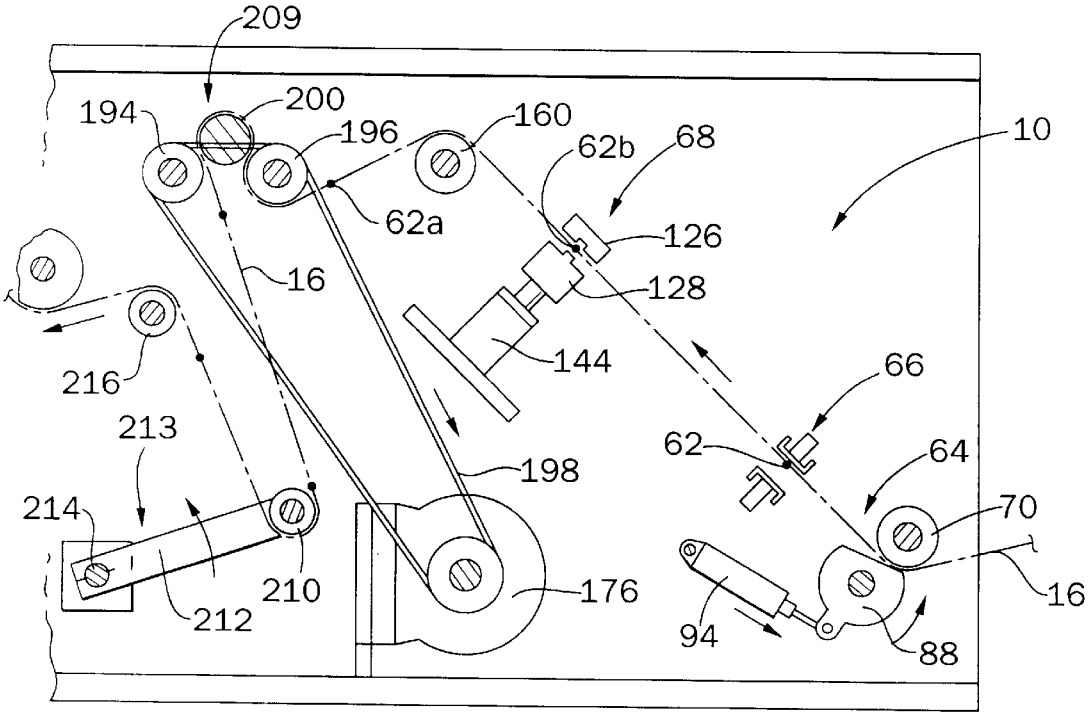
FIG. 10

FORMING WEB REGISTRATION CONTROL SYSTEM

FIELD OF THE INVENTION

The invention relates generally to an indexing motion packaging machine for producing discrete packages of articles such as vacuum packaged food products or the like. More particularly, it pertains to a registration control system for a pre-printed forming web of the packaging machine.

BACKGROUND AND SUMMARY OF THE INVENTION

Indexing motion packaging machines are used for producing double webbed packages used in a variety of applications, such as for packaging systems of food products like frankfurters, luncheon meats, cheese or the like. In such packaging systems, a bottom forming web is fitted into the packaging machine at a tail end of the machine and supported from an arbor system such as described in copending U.S. patent application Ser. No. 08/531,071 filed Sep. 20, 1995 in the name of the inventor of this application. The bottom forming web is fed via a dancer arm arrangement to a gripper chain which advances the forming web to a vacuum forming box system which vacuum forms the bottom web in an upwardly facing cavity within which the product is loaded. The formed web and product are then advanced downstream where a second or top web is fed in and sealed to the formed web over the product and product cavity. The double webbed, sealed package is then discharged from the machine, and longitudinal and transverse cuts are made to separate the web and product into individual packages.

In order to provide the sealed packages with information such as logos, trademarks, cooking instructions, nutritional information, etc., it is necessary to provide the bottom forming web with the noted information pre-printed thereon at regular intervals defined by small registration marks also pre-printed on the bottom web. The web printing is continually carried out so as to be slightly compressed and shorter than the known desired final spacing, due to inaccuracies in the printing process and variables in the web film being printed so that the end user must stretch the film as desired to obtain the final spacing. Further, the information on the web is distorted such that it appears normal after the web has been formed to define the product-receiving cavity.

Some prior art systems have attempted to attain the correct registration of the pre-printed web by heating the entirety of the web to provide a certain amount of stretch as the web is fed into the packaging machine. However, such systems have proven difficult to control in that the web film loses its rigidity and is difficult to advance through the machine.

There remains a need, especially in the packaging field, to provide a registration control system for consistently stretching and heating a pre-printed web to obtain accurate and precise intervals in which distorted printing is effectively transformed into legible information consistently and properly positioned on each package.

It is one object of the present invention to provide a registration control system for the bottom forming web of an indexing motion packaging machine. It is another object of the present invention to provide a web registration control system utilizing a braking arrangement, a photosensing mechanism and a heater system for enabling the transformation of distorted information pre-printed on the web. It is another object of the present invention to provide a web registration control system which relies on a combination of stretching and heating applied to the web between a supply roll and a web advancement mechanism. It is a further object of the present invention to provide a web registration control system which offers repeatability and consistency in correctly positioning a forming web. Yet another object of the present invention is a method of obtaining precise registration of a forming web in an indexing motion packaging machine. Still yet another object of the present invention is to provide a web registration control system which is easily accommodated between a web supply roll and a web advancement mechanism.

In one aspect of the invention, there is provided a registration control system for a movable web pre-printed with a series of registration marks and fed from a supply roll by an unwind motor. The system includes a framework on which the supply roll and the unwind motor are mounted. A braking arrangement is connected to the framework and is selectively engaged with the web to stop the unwinding thereof. A photosensing mechanism is located downstream from the braking arrangement on the framework for sensing a registration mark on the web. A heater system is disposed downstream from the photosensing mechanism on the framework for selectively applying heat to the web upon the next registration mark downstream from the registration mark sensed at the photosensing mechanism. The web is engageable with a nip roller arrangement formed by a pair of spaced driven rollers disposed on the framework in driving engagement with the unwind motor and a nip roller located between the driven rollers and engaged with each driven roller. The braking arrangement includes a lower idler roller mounted on the framework, a brake roller movably connected on the framework, the web passing over the lower idler roller and the brake roller, and an actuating device for selectively moving the brake roller against the web and the lower idler roller. In the preferred embodiment, the actuating device is a first hydraulic cylinder having a cylinder end connected to the framework and a rod end joined to the brake roller. The photosensing mechanism is adjustably positioned on the framework relative to the braking arrangement. The photosensing mechanism includes a pair of opposed, elongated, substantially parallel guide channels, one on either side of the web, with one of the channels carrying a transmitting element and the other of the channels bearing a cooperating receiving element. The heater system is adjustably positioned on the framework relative to the photosensing mechanism. The heater system includes a pair of opposed heater elements between which the web is passed. One of the heater elements is selectively movable towards and away from the web and the other of the heater elements. One of the heater elements is associated with a rod end of a second hydraulic cylinder. An upper idler roller is disposed on the framework between the driven rollers and the heater system for engagement with the web.

Another aspect of the present invention relates to a web advancement mechanism having a selectively movable web fed from a supply roll by an unwind motor. The web has spaced registration marks for defining areas of distorted printing provided thereon. The improvement resides in a web registration control system located between the supply roll and the web advancement mechanism constructed and arranged to sense a registration mark on the web at a first location between the supply roll and the unwind motor, heat the web upon the next adjacent downstream registration mark while the web is stopped, and operate the unwind motor while the web is prevented from unwinding from the supply roll to create tension in a second location downstream of the first location. These functions are performed in a manner such that the web will be sufficiently stretched to a constant length to effectively transform the distorted printing into legible printing as the web continues being delivered into the web advancement mechanism which is preferably located in the indexing motion packaging machine. The web is engageable with a nip roller engagement located downstream from the second location, and formed by a pair of spaced driven rollers in driving engagement with the unwind motor and a nip roller located between the driven rollers and engaged with each driven roller. A dancer mechanism is located downstream of the nip roller arrangement for advancing the constant length of stretched web into the web advancement mechanism. The registration mark sensed on the web is detected by an adjustable photosensing mechanism. The web is prevented from unwinding from the supply roller by a braking arrangement located upstream of the photosensing mechanism and selectively engaged with the web upon detection of the registration mark by the photosensing mechanism. The web is heated in a localized area by a heater system disposed downstream from the photosensing mechanism.

Yet a further aspect of the invention relates to a method of registering a web fed from a supply roll by an unwind motor in a web advancement mechanism, the web having spaced registration marks for defining areas of distorted printing provided thereon. The method comprises the steps of: a) using the unwind motor to apply a stretching to the web upon sensing of a registration mark on the web fed from the supply roll and simultaneously stopping the web at a position upstream from the sensed registration mark; and b) heating the web upon the registration mark at a location spaced a predetermined distance downstream of the sensed mark. The combination of the stretching and heating transforms each area of distorted printing into legible printing as the web continues into the web advancement mechanism.

Still yet a further aspect of the invention relates to a method of obtaining precise registration of a forming web in an indexing motion web mechanism. The web has spaced registration marks for defining an area of distorted printing provided thereon. The method comprises the steps of: a) passing the web from a supply roll through a braking arrangement, a photosensing mechanism for sensing the registration marks on the web and a heater system movable back and forth relative to the web to a nip roller arrangement having one or more rolls driven by the unwind motor; b) indexing the web from the supply roll by operation of the unwind motor; c) sensing the presence of a first registration mark on the web by the photosensing mechanism; d) immediately stopping the feeding of the web from the supply roll using the braking arrangement; e) stretching the web downstream of the braking arrangement by continuing to operate the unwind motor to apply tension to the web; f) stopping the unwind motor; and g) applying heat to the web by moving the heater system towards the web upon the adjacent registration mark downstream of the first registration mark to attain a predetermined precise length for supply into the web advancement mechanism downstream of the nip roller arrangement.

Various other objects, features and advantages of the invention will be made apparent from consideration of the following description taken together with the drawings.

BRIEF DESCRIPTION OF THE SEVERAL VIEWS OF THE DRAWINGS

The drawings illustrate the best mode presently contemplated of carrying out the invention. In the drawings:

FIG. 5 is a sectional view taken on line 5—5 of FIG. 3 showing the heater system in an inoperative position relative to the bottom forming web;

FIG. 6 is a view similar to FIG. 5 showing the heater system in an operative position relative to the bottom forming web;

FIGS. 9–11 are sequential diagrammatic views of the web registration control system showing the steps of indexing, sensing, braking and initially stretching, and heating and further stretching the bottom forming web.

DETAILED DESCRIPTION OF THE INVENTION

Figure 1:
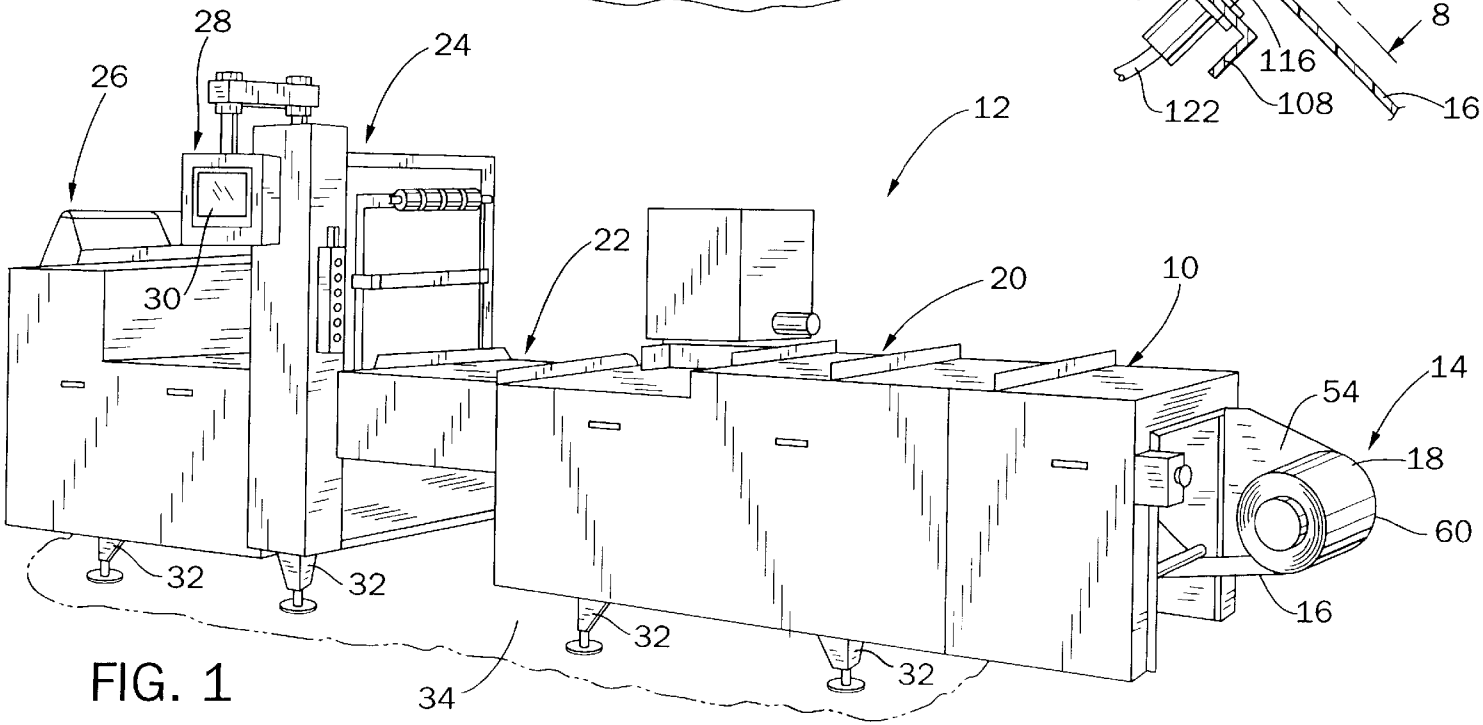
FIG. 1 is an isometric view of an indexing motion packaging machine embodying a web registration control system for supplying a bottom forming web of pre-printed packaging material.

Referring now to FIG. 1, the web registration control system 10 embodying the present invention is preferably used in conjunction with an indexing motion packaging machine 12 used to produce a double webbed package in which a quantity of product is sealed. It should be understood however, that the particular packaging machine 12 is for illustrative purposes only, and that the registration control system 10 is adaptable to any web advancement mechanism in which a web must be directly positioned or registered at some stage of its travel.

Packaging machine 12 generally includes a bottom web supply station 14 for supplying a bottom forming web 16 of flexible packaging film from a supply roll 18, a forming station 20, a loading station 22, a top web supply station 24 for supplying a top web of flexible packaging film, and a processing station 26. The operations of the processing station 26 include sealing the top and bottom webs together to form a series of interconnected packages which are then severed to separate the web and product into separate packaging units.

A control module 28 is pivotably connected to the upper end of the top web supply station 24 for movement to varying positions by an operator of the machine 12. The control module 28 includes a touch screen 30 for controlling the key operating parameters of machine 12.

Figure 2:
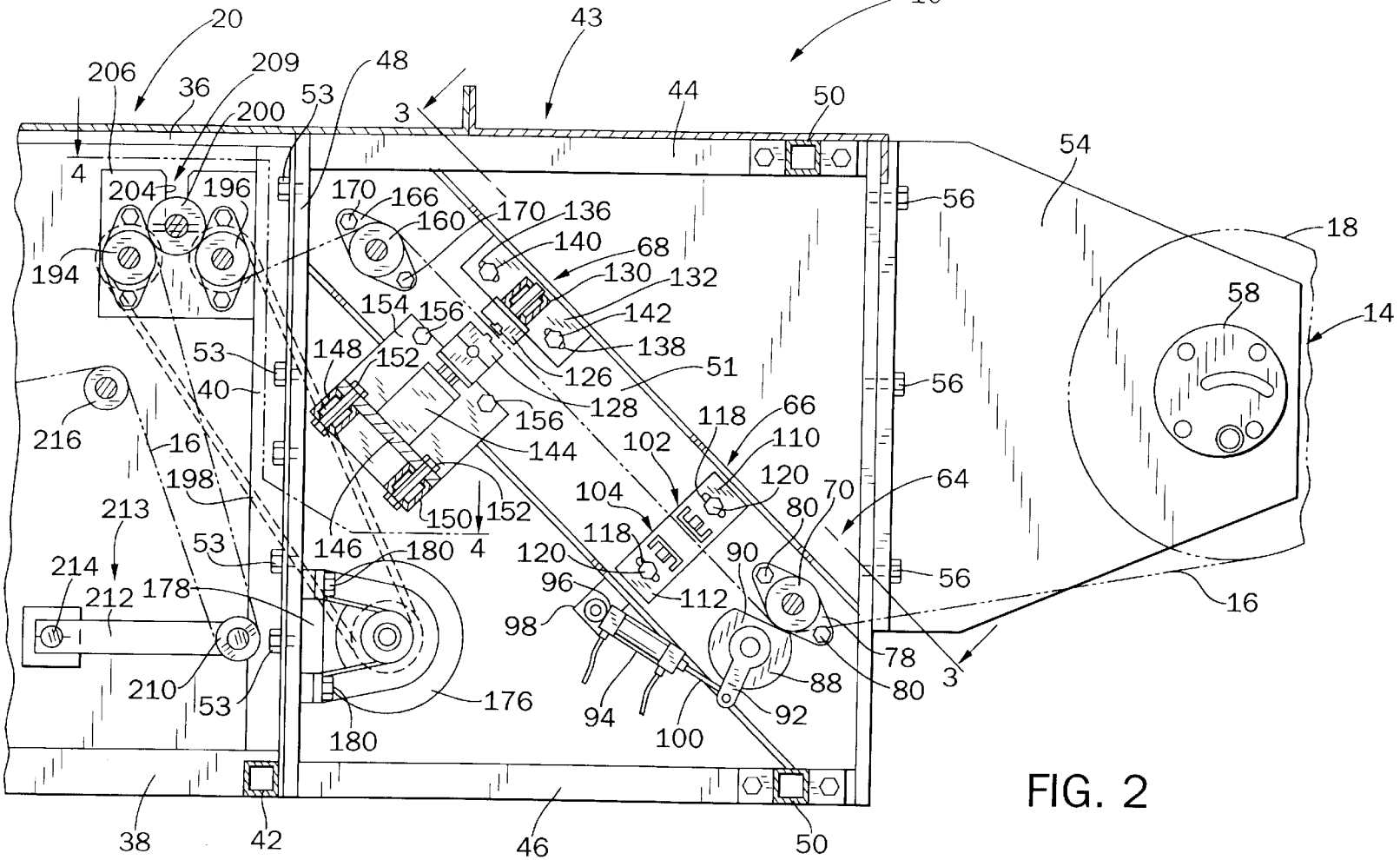
FIG. 2 is an enlarged side elevational view of the web registration control system shown in FIG. 1 with guards and covers removed to expose the internal components of the machine.

Each of the interconnected stations 20,22,24,26 forms a continuous framework assembly which is supported by legs 32 above a floor 34. As seen in FIG. 2, forming station 20 includes a pair of spaced, parallel upper frame members, one being shown at 36, a pair of spaced, parallel lower frame members, one being shown at 38, and a series of spaced vertical frame members, such as shown at 40, extending between each upper frame member 36 and lower frame member 38. Additionally, a series of reinforced cross members, such as shown in 42, interconnect each respective pair of upper and lower frame members 36,38. Similarly, web registration control system 10 includes a framework 43 having a pair of spaced, parallel upper frame members, one being shown at 44, a pair of spaced, parallel lower frame members, one being shown at 46, a series of spaced vertical frame members such as shown at 48, and a series of cross members, such as shown at 50. In addition, the framework 43 includes a pair of angularly disposed support members 51,52 (FIGS. 2–3) for mounting the various operating components of web registration control system 10 as will be explained hereafter. An array of vertically aligned fasteners 53 are used to interconnect the adjoining vertical frame members 40,48 so that web registration control system 10 is supported from and easily accommodated on the rear end of forming station framework 43.

Bottom web supply station 14 includes a load support bracket 54 which is secured by vertically spaced fasteners 56 to one of the vertical frame members 48 of web registration control system 10. The supply roll 18 carrying bottom forming web 16 is rotatably mounted on a roll support, guide and braking mechanism 58 such as is disclosed in the aforementioned copending U.S. patent application Ser. No. 08/531,071, the disclosure of which is herein incorporated by reference.

In order to provide the packages to be formed with information such as logos, trademarks, cooking information, nutrition information, etc., the bottom forming web 16 is provided with the noted information 60 (FIG. 1) pre-printed thereon. This printed information 60 appears at regular intervals defined by small registration marks 62 (FIG. 8) also pre-printed usually along the edge of the bottom forming web 16. The web printing is continually applied to the web so as to be slightly distorted or compressed, so that when the web 16 is formed to its final package shape, the web printing appears normal. Further, the web printing is printed at an interval slightly shorter than the known desired final spacing, due to inaccuracies in the printing process and variables in the web being printed. For example, web 16 may be printed such that the spacing between registration marks 62 is 11.875 inches for a desired final spacing of 12.00 inches, and web 16 thus must be stretched slightly to attain the desired final spacing.

The invention resides in consistently stretching the pre-printed web 16 to obtain accurate and precise length for each package formed using web 16, so that the distorted or compressed printing is consistently located properly relative to the forming tooling to be converted into normal readable information which, in the preferred embodiment, may be consistently and properly positioned with a cooperating web to form a sealed printed package.

In accordance with the invention, the web registration control system 10 comprises a braking arrangement 64 connected to the frame work 43 and selectively engaged with the web 16 to stop unwinding thereof, a photosensing mechanism 66 located downstream of the braking arrangement 64 on the framework 43 for sensing a registration mark 62 on the web 16, and a heater system 68 disposed downstream of the photosensing mechanism 66 for selectively applying heat to the web 16 in the vicinity of the next registration mark 62 downstream from the registration mark sensed at the photosensing mechanism 66.

Figure 3:
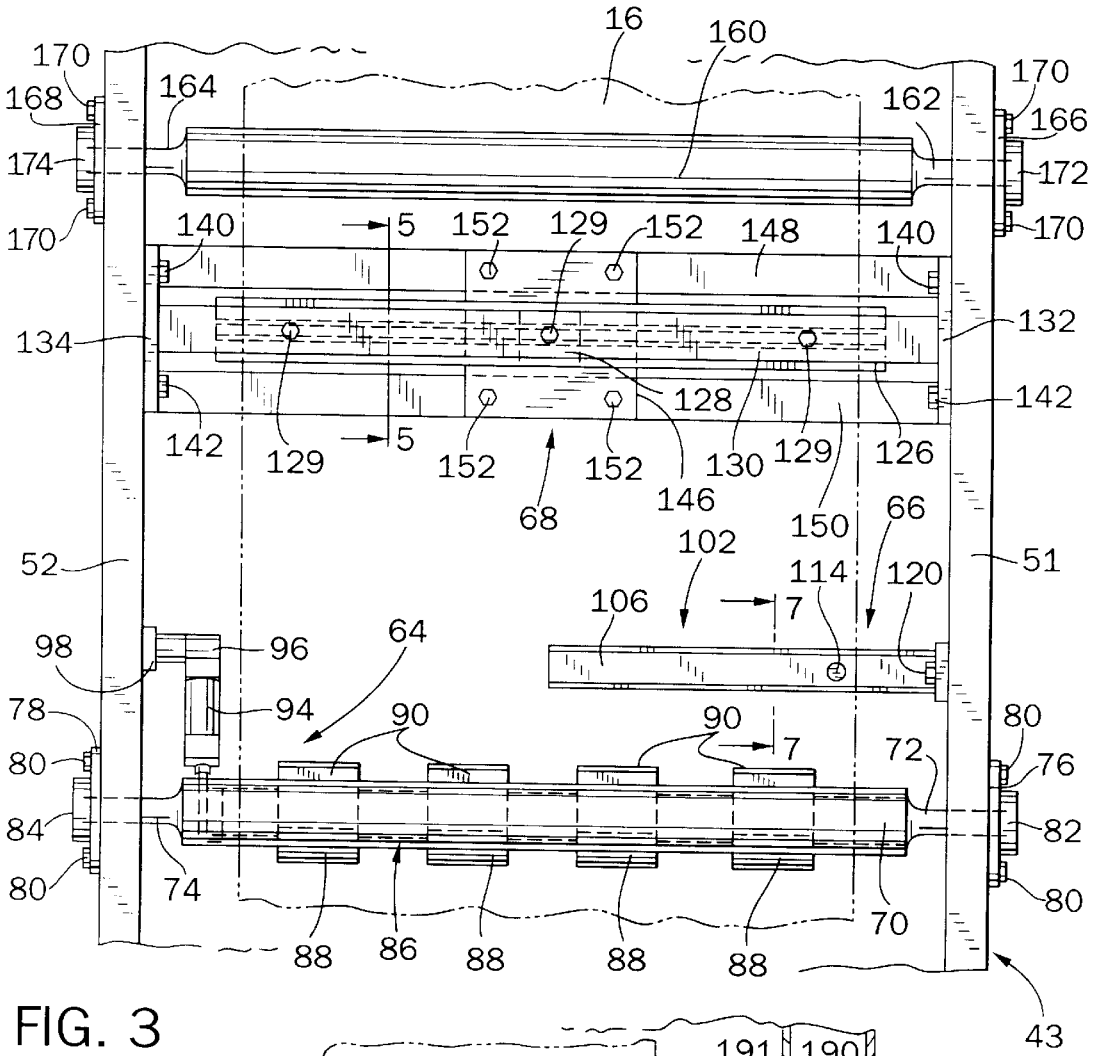
FIG. 3 is a sectional view taken on line 3—3 of FIG. 2 showing the lower idler roller, the brake roller, the photosensing mechanism, the heater system and the upper idler roller of the present invention.

As seen in FIGS. 2 and 3, braking arrangement 64 includes a lower idler roller 70 about which the web 16 is entrained upon being unwound from supply roll 18. Lower idler roller 70 extends transversely across the entire width of the framework 43 and has opposite, reduced end portions 72,74 that pass freely through suitable apertures in the angular support members 51,52 and respective mounting brackets 76,78 affixed to the outside of support members 51,52 by fasteners 80. Enlarged bearing ends 82,84 are provided on each respective end portion 72,74 for preventing shifting of the lower idler roll 70 while allowing free rotation thereof. Mounted beneath lower idler roller 70 is a brake roller having a shaft 86 to which a series of spaced brake members 88 are non-rotatably mounted. Each brake member 88 has a flat braking surface 90 formed of a relatively soft material which will not damage the web 16. An arm 92 is mounted to the shaft 86 and a brake actuating cylinder 94 has a cylinder end 96 pivotally connected to a bracket 98 projecting from angular support member 52. The lo brake cylinder 94 also has a rod end 100 connected to the end of the arm 92 for selectively rotating the arm 92 to turn the shaft 86 and bring the brake member 88 into contact with the web 16 against lower idler roller 70, and for rotating the arm 92 in the opposite direction to release engagement of the brake members 88 with the web 16.

Figure 7:
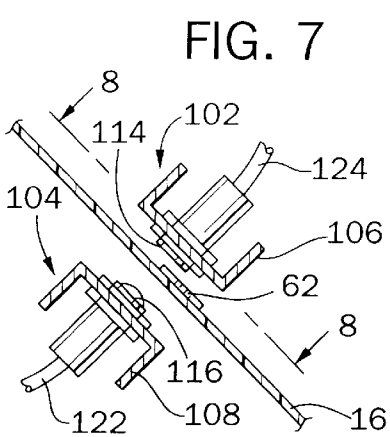
FIG. 7 is a sectional view taken on line 7—7 of FIG. 3 showing the photosensing mechanism relative to the bottom forming web.
Figure 8:
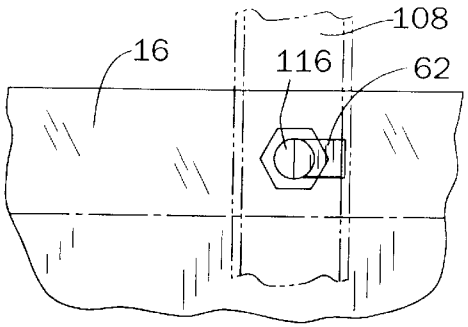
FIG. 8 is a sectional view taken on line 8—8 of FIG. 7 showing a registration mark on the bottom forming web as sensed by the photosensing mechanism.

Referring to FIGS. 2, 3, 7 and 8, photosensing mechanism 66 includes a pair of spaced apart, opposed support bars 102,104 between which the web 16 passes after engagement with the lower idler roller 70. Support bars 102,104 have a generally U-shaped channel portion 106,108, respectively, and an end bracket 110,112, respectively, disposed at a substantially right angle thereto. Channel 106 is used to mount a conventional photoeye receiving element 114, while channel 108 supports a conventional, cooperating photoeye transmitting element 116 in opposed relationship with element 114. Each end bracket 110,112 is formed with a horizontal slot 118 through which a fastener 120 is passed for attachment to angular support member 51. This mounting allows the support bars 102,104 and the photoeye elements 114,116 mounted thereon to be adjustably positioned towards and away from braking arrangement 64 and heater system 68. Transmitting element 116 normally operates to shine a beam of light such as delivered through a fiber optic cable 122 through the web film to the receiving element 114. When any registration mark 62 on the moving web 16 interrupts the light beam, as shown in FIG. 8, a signal is sent through a fiber optic cable 124 to the control center of the machine 12 to immediately clamp the brake members 88 against moving web 16 and lower idler roller 70 for purposes that will be understood later.

Heater system 68, shown in FIGS. 2, 3, 5 and 6 is comprised of an upper heater unit 126 and a lower heater unit 128 between which web 16 is passed. Upper heater unit 126 is secured by fasteners 129 to the underside of an elongated upper support tube 130 which extends across the width of framework 43 and terminates in rectangular support brackets 132,134 joined generally perpendicularly to support tube 130. Upper heater unit 126 has a length which is shorter than the width of the framework 43 but longer than the width of web 16 so as to fully expose the web to heat when desired. Each of the support brackets 132,134 is provided with a pair of slots 136,138 disposed on either side of support tube 130. Fasteners 140,142 are passed through respective slots 136,138 and screwed into respective angular support members 51,52 to support heater unit 126 therefrom. Lower heater unit 128 is mounted for selective movement towards and away from upper heater unit 126 by means of a lo cylinder 144 projecting from a square support plate 146. Plate 146 is supported upon a pair of substantially parallel, lower support tubes 148,150 and attached thereto by a series of fasteners 152. At the end of each of the support tubes 148,150 is an auxiliary support plate 154 (FIG. 2) which is secured to angular support members 51,52 by fasteners 156. Cylinder 144 has a rod end 158 connected to lower heater unit 128 and is selectively operated to move lower heater unit 128 between an inoperative position shown in FIG. 5, in which the heater units 126,128 are spaced from the web 16, and an operative position shown in FIG. 6 in which the heater units 126,128 are positioned closely adjacent or in engagement with opposite sides of the web 16.

After the web 16 passes between the heater units 126,128, it is wound about an upper idler roller 160 which extends across the entire width of framework 43. Like lower idler roller 70, upper idler roller 160 has opposite, reduced end portions 162,164 which pass freely through suitable apertures in the angular support members 51,52 and respective bearings 166,168 fixed to the exterior of support members 51,52 by fasteners 170. Enlarged bearing ends 172,174 are provided on each respective end portion 162,164 for preventing shifting of the upper idler roller 160 while allowing free rotation thereof.

Figure 4:
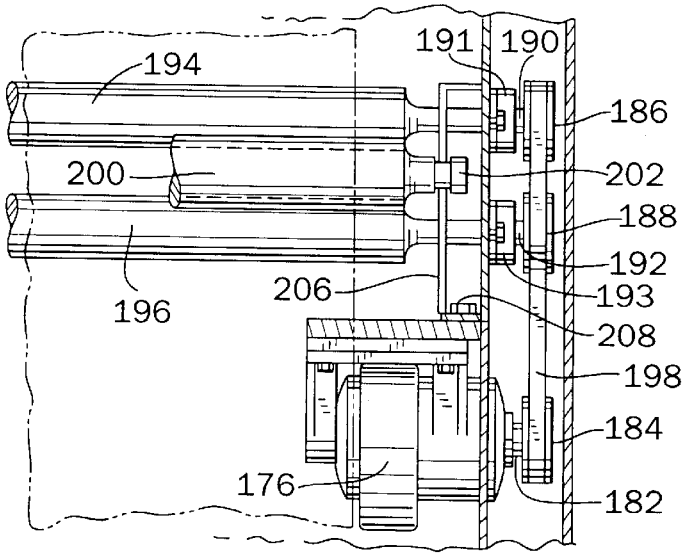
FIG. 4 is a sectional view on line 4—4 of FIG. 2 showing the indexing servomotor, and the cooperating nip roller arrangement of the present invention.

With reference now to FIGS. 2 and 4, an unwind motor 176, in the form of a variable speed servo motor, is mounted to a plate 178 attached to the framework 43 by fasteners 180. Servo motor 176 has its output shaft 182 connected to a motor drive pulley 184. A pair of timing pulleys 186,188 are fixed to a pair of shafts 190,192, respectively, which, in turn, are supported by bearings 191,193, respectively, and fixed to a pair of driven rollers 194,196, respectively, extending across the width of the framework in the forming station 20. A timing belt 198 is trained around timing pulleys 186,188 and drive pulley 184 engaged on motor output shaft 182.

A nip roller 200 rests on top of driven rollers 194,196 forming a pair of nips between roller 200 and rollers 194,196. As shown in FIGS. 2 and 4, nip roller 200 has a reduced end portion 202 which rides in a vertical slot 204 formed in a support plate 206 attached to the machine framework by fastener 208. Bottom forming web 16 is fed from upper idler roller 160, under driven roller 196, up and over nip roller 200 and below driven roller 194. Upon operation of servo motor 176, rollers 194,196 are driven in response to rotation of timing pulleys 186,188 and drive pulley 184, and bottom web 16 is unwound from supply roll 18 by rotation of driven rollers 194,196 and nip roller 200 which form a nip roller arrangement 209.

From driven roller 194, bottom web 16 is trained around a dancer roller 210 rotatably mounted to a dancer arm 212 which is pivotably supported on a shaft 214 extending across the width of the forming station framework. Dancer roller 210 and dancer arm 212 form a dancer mechanism 213 which reacts to the feeding of the web 16 from the supply roll 18 relative to the web 16 being indexed into the forming and other downstream stations 20,22,24,26. Web 16 proceeds from dancer roller 210 to an idler roller 216 in forming station 20 and is directed to a gripper chain mechanism (not shown) for continuing the movement of the web 16 through the web advancement mechanism of the machine 12. Such a gripper chain mechanism is more fully described in U.S. Pat. No. 5,205,110 issued Apr. 27, 1993, the disclosure of which is incorporated herein by reference.

FIGS. 9–11 illustrate the manner in which the web registration control system 10 is put to use in the indexing motion packaging machine 12. Before a package forming run is started, the machine operator establishes a positioning of the braking mechanism 64 and the photosensing mechanism 66 for a desired indexing length, knowing that the printed information defined between adjacent registration marks 62 is slightly shorter than the desired index. Initially, as illustrated in FIG. 9, the braking arrangement 64 is unclamped and the heater system 68 is in the inoperative position with heater units 126,128 spaced from bottom forming web 16. Upon actuation of servo motor 176, web 16 will be unwound from supply roll 18 and flows freely through braking arrangement 64 until registration mark 62 is sensed by photosensing mechanism 66. Immediately upon detecting the mark 62, as depicted in FIG. 10, the system will utilize cylinder 94 to clamp brake elements 88 tightly against web 16 and lower idler roller 70 so as to temporarily stop the dispensing of web 16 from supply,roll 18. With the dispensing of the web 16 from supply roll 18 stopped, dancer mechanism 213 pivots upwardly to accommodate the demand to index more web film to the various downstream stations 20,22,24,26. Dancer mechanism acts as a repository for storing the necessary amount of web needed by the indexing machine. At the same time brake elements 88 are applied, servo motor 176 will continue to run for a short duration, during which a stretching force is generally applied in the area of web 16 surrounding registration mark 62*a* which is previously heated at heater system 68. Shortly thereafter, the unwinding motor 176 is stopped and cylinder 144 will bring heater units 126,128 into the operative position of FIG. 11 so as to heat web 16 directly in the location of the registration mark 62*b* downstream of the registration mark 62 at the photosensing mechanism 66. Dancer mechanism 213 will continue to pivot upwardly to accommodate the demand of the downstream stations 20,22, 24,26 until the motor 176 is against actuated. The effect of the combined stretching and heating effectively stretches each area between adjacent registration marks to provide a constant, fixed predetermined length of web 16 between adjacent registration marks according to the revolutions of drive rollers 194,196 by servo motor 176, which is controlled in response to operator inputs at control module 28. Once the proper indexing length has been obtained, the web 16 will move through the nip roller arrangement 209 to the dancer mechanism 213 and downstream stations 20,22,24, 26 where the web 16 will be vacuum formed, loaded with product, sealed with a top web and cut into individual packages as is well known. When the heater units 126,128 are moved apart, the brake members 88 are released and motor 176 is activated to advance the web 16 from the supply roll 18 in the manner described above.

It should also be noted that the operator can visually detect the position of the registration mark 62 on the tooling and adjust manually on the fly if there is slippage between the web 16 and drive rollers 194,196 or, if for any reason, there is excessive or inadequate stretch. Additionally, the operator can watch the registration eye 62 at the sealing end of the machine and automatically compensate for stretching as needed.

It is important to appreciate that the present invention provides a web registration control system which offers repeatability and consistency in correctly positioning and forming the web. The present invention also enables consistent stretching of a pre-printed web to effectively provide a properly positioned body of legible printed information on each package formed by the packaging machine.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A web registration control system for a movable web pre-printed with a series of registration marks and fed from a supply roll by an unwind arrangement, the system comprising:

a braking arrangement located upstream of the unwind arrangement and selectively engageable with the web to stop the unwinding thereof;

a sensing mechanism for sensing the registration marks on the web; and a heater system disposed between the braking arrangement and the unwind arrangement for selectively applying heat to the web in the vicinity of the registration marks downstream from the sensing mechanism;

wherein while unwinding of the web is stopped by the braking arrangement the braking arrangement is operable to selectively stop unwinding of the web and wherein the unwind arrangement is operable to stretch the web, at a heated area of the web created by operation of the heater system to provide a desired spacing between registration marks on the web.

2. The system of claim 1, wherein the unwind arrangement comprises a nip roller arrangement formed by a pair of spaced drive rollers in driving engagement with an unwind motor, and a nip roller located between the drive rollers and engaged with each drive roller.

3. The system of claim 1, wherein the braking arrangement includes an idler roller and a movable brake member, wherein the web passes between the idler roller and the brake member, and an actuating device for selectively moving the brake member against the web and the idler roller.

4. The system of claim 3, wherein the actuating device comprises a hydraulic cylinder having a fixed cylinder end and a rod end secured to an arm interconnected with the brake member.

5. The system of claim 1, wherein the sensing mechanism comprises a photosensing mechanism adjustably positioned relative to the braking arrangement.

6. The system of claim 1, wherein the heater system is adjustably positioned relative to the sensing mechanism.

7. The system of claim 1, wherein the heater system includes a pair of opposed heater units elements between which the web is passed, one of the heater units being selectively movable towards and away from the web and the other of the heater units.

8. The system of claim 7, wherein one of the heater elements is associated with a rod end of a hydraulic cylinder.

9. The system of claim 2, including:

an upper idler roller disposed on the framework between the drive rollers and the heater system for engagement with the web.

10. The system of claim 1, wherein the unwind motor is a servo motor.

11. A web registration control system for a movable web pre-printed with a series of registration marks and fed from a supply roll by an unwind motor, the system comprising:

a framework on which the supply roll and unwind motor are mounted:

a braking arrangement connected to the framework and selectively engageable with the web to stop the unwinding thereof;

a photosensing mechanism located downstream from the braking arrangement on the framework for sensing a registration mark on the web, wherein the photosensing mechanism includes a pair of opposed, elongated, substantially parallel guide channels, one on either side of the web, one of the channels carrying a photoeye transmitting element and the other of the channels carrying a cooperating photoeye receiving element; and a heater system disposed downstream from the photosensing mechanism on the framework for selectively applying heat to the web upon the next registration mark downstream from the registration mark sensed at the photosensing mechanism.

12. In a web advancement mechanism having a selectively movable web fed from a supply roll by an unwind motor, the web having spaced registration marks, the improvement comprising:

a web registration control system located between the supply roll and the web advancement mechanism constructed and arranged to sense a registration mark on the web between the supply roll and the unwind motor wherein the web is heated, at a first location while the web is stopped and, wherein prior to heating the web, operating the unwind motor while the web is prevented from unwinding from the supply roll to create tension in a previously heated second location downstream of the first location in a manner such that the web is stretched at the second location to a predetermined length between adjacent registration marks.

13. The improvement of claim 12, wherein the web advancement mechanism is located in an indexing motion packaging machine.

14. The improvement of claim 12, wherein the web is engageable with a nip roller arrangement located downstream from the second location and formed by a pair of spaced driven rollers in driving engagement with the unwind motor and a nip roller located between the driven rollers and engaged with each driven roller.

15. The improvement of claim 14, including a dancer mechanism located downstream of the nip roller arrangement for advancing the predetermined length of stretched web into the web advancement mechanism independently of the web registration control system.

16. The improvement of claim 12, wherein the registration mark sensed on the web is detected by an adjustable photosensing mechanism.

17. The improvement of claim 16, wherein the web is prevented from unwinding from the supply roll by a braking arrangement which is selectively engaged with the web upon detection of the registration mark by the photosensing mechanism.

18. The improvement of claim 17, wherein the web is heated in a localized area by a heater system disposed downstream from the photosensing mechanism.

19. A method of controlling registration of a web fed from a supply roll by a web advancement mechanism, the web having spaced registration marks, the method comprising the steps of:

a) positioning a first heated area of the web upstream of the web advancement mechanism;

b) operating the web advancement mechanism to apply a stretching force to the web at the first heated area while simultaneously stopping the web at a position upstream from the web advancement mechanism and the first heated area;

c) subsequently heating the web at a second heated area upstream of the first heated area; and d) advancing the web by operation of the web advancement mechanism such that the first heated area is located downstream of the web advancement mechanism and the second heated area is located upstream of the web advancement mechanism whereby the second heated area is adapted to be stretched by operation of the web advancement mechanism while the web is stopped, at a location upstream of the web advancement mechanism.

20. A method of obtaining precise registration of a forming web in an indexing motion web advancement mechanism, the web having spaced registration marks, the method comprising the steps of:

a) passing the web from a supply roll through a braking arrangement, a sensing mechanism for sensing the registration marks on the web and a heater system movable back and forth relative to the web to a nip roller arrangement having one or more driven rolls driven by the unwind motor, wherein the heater system is operable to create a first heated area of the web;

b) indexing the web from the supply roll by operation of the unwind motor;

c) sensing the presence of a first registration mark on the web upstream of the first heated area by the sensing mechanism;

d) stopping the feeding of the web from the supply roll using the braking arrangement upon sensing of the first registration mark;

e) stretching the web downstream of the heater system at the first heated area by continuing to operate the unwind motor to apply tension to the web;

f) stopping the unwind motor when the web is stretched an amount sufficient to provide a desired spacing between a pair of registration marks which at least partially includes the first heated area; and g) applying heat to the web in a second heated area by moving the heater system towards the web upstream of the first heated area.

21. A web registration control system for a movable web imprinted with a series of variably spaced registration marks, wherein the space between adjacent registration marks is less than a predetermined spacing, comprising:

an intermittently operable web advancement mechanism;

a braking mechanism located upstream of the web advancement mechanism and selectively engageable with the web;

a sensing mechanism located upstream of the web advancement mechanism; and a heating arrangement located upstream of the web advancement mechanism adjacent the web;

wherein the heating arrangement is operable to provide a first heated area between the braking arrangement and the web advancement mechanism so that operation of the braking mechanism stops advancement of the web and simultaneous operation of the web advancement mechanism stretches the web at the first heated area, and wherein the web advancement mechanism is operable to provide a variable amount of stretch at the first heated area to enable the space between a pair of adjacent registration marks, which includes the first heated area, to substantially equal the predetermined spacing; and wherein the heating arrangement is operable to provide a second heated area upstream of the first heated area and the web advancement mechanism is operable to advance the first heated area after stretching past the web advancement mechanism to enable subsequent stretching of the web at the second heated area by operation of the braking mechanism and the web advancement mechanism.

22. The system of claim 21, wherein the web advancement mechanism comprises a motor for driving at least one drive roller about which the web is trained, and wherein the braking mechanism comprises a brake roller located upstream of the driven roller about which the web is trained, and a brake member located adjacent the brake roller and selectively operable to pinch the web between the brake roller and the brake member.

23. The system of claim 21, wherein the sensing mechanism comprises a photosensor arrangement located between the web advancement mechanism and the braking mechanism.

24. The system of claim 21, wherein the heating arrangement comprises a heater member located between the web advancement mechanism and the braking mechanism and selectively movable toward and away from the web for selectively heating an isolated area of the web.

* * * * *

UNITED STATES PATENT AND TRADEMARK OFFICE

CERTIFICATE OF CORRECTION

PATENT NO. : 6,085,490
DATED : July 11, 2000
INVENTOR(S) : Raymond G. Buchko

It is certified that error appears in the above-identified patent and that said Letters Patent is hereby corrected as shown below:

Claim 7, column 9,
Line 46, delete "units";
Line 47, delete "units" and substitute therefor -- elements --;
Line 49, delete "units" and substitute therefor -- elements --;

Claim 8, column 9,
Line 51, before "hydraulic" insert -- second --;

Claim 9, column 9,
Line 52, delete "2" and substitute therefor -- 1 --;

Claim 15, column 10,
Line 39, delete "predetermined" and substitute therefor -- constant --;

Signed and Sealed this

Eighteenth Day of September, 2001

*Attest:*

Nicholas P. Godici

*Attesting Officer*

NICHOLAS P. GODICI
*Acting Director of the United States Patent and Trademark Office*